US005839931A

United States Patent [19]

Shieh

[11] Patent Number: 5,839,931

[45] Date of Patent: Nov. 24, 1998

[54] SAFETY STOP ANCHOR

[76] Inventor: Steve S. Shieh, No. 480, Chung Shan North Road, Section 5, Taipei, Taiwan

[21] Appl. No.: 63,728

[22] Filed: Apr. 24, 1998

[51] Int. Cl.[6] ..... B63B 22/16

[52] U.S. Cl. ..... 441/6; 441/30; 441/89

[58] Field of Search ..... 114/294, 311; 441/1, 6, 30, 80, 84, 88, 89

[56] References Cited

U.S. PATENT DOCUMENTS

| | | | |
|---|---|---|---|
| 736,692 | 8/1903 | Condren | 441/6 |
| 1,025,497 | 5/1912 | Wensley | 441/6 |
| 3,209,382 | 10/1965 | Scott | 441/6 |
| 4,563,157 | 1/1986 | Hoshino | 114/311 |
| 5,030,152 | 7/1991 | Carr et al. | 441/89 |

*Primary Examiner*—Stephen Avila
*Attorney, Agent, or Firm*—Bacon & Thomas

[57] ABSTRACT

Disclosed is a safety stop anchor including a buoy distantly connected to a diver via a fixing rope. Before the diver returns to the surface, the buoy helps the diver to easily and relaxedly stay at the required safety decompression stop or stops to avoid the caisson disease. A buoyancy control valve is provided on the buoy so that heavy loads can be more easily carried underwater by a neutral buoyancy and to ascend to the water surface.

3 Claims, 9 Drawing Sheets

SAFETY STOP ANCHOR

BACKGROUND OF THE INVENTION

Underwater sports are activities good for strengthening our body and healthy organic functions while they enable us to explore secrets in deep sea and/or to proceed underwater engineering works. In recent years, diving has become a popular underwater activity. Generally, diving can be divided into two types, namely, skin diving and scuba diving. The main difference between these two types of diving lies in a Self-contained Underwater Breathing Apparatus (SCUBA) which automatically supplies air to the diver under water. Usually, a basic set of necessary diving equipment for a diver includes a diving suit (or buoyancy control), diving goggles or diving mask, a snorkel, an aqualung, flippers, and a depth gauge. With the depth gauge, a diver may know how deep he or she is below the sea surface. Whenever the diver intends to return to the surface, he or she must gradually ascend according to the reading indicated by the depth gauge to avoid caisson disease caused by sudden expansion of gas in the body due to failing to make decompression stop for a standard decompression time. On the other hand, when the diver uses a depth gauge to locate a standard decompression stop below the sea, he or she has to continuously stroke and kick to balance the buoyancy of sea water to keep his or her body below the sea at a required depth. However, it is very difficult and almost impossible for a diver to do so due to the wavy sea. Moreover, it is preferably for the diver to maintain in a relaxed condition during the course of decompression. It is therefore desirable to provide means to help the diver effectively and actually perform a safe decompression under the sea.

SUMMARY OF THE INVENTION

The present invention relates to a safety stop anchor which mainly includes a buoy, a length of fixing rope, and a storage pocket. The fixing rope has two loop ends separately connected to the buoy and the storage pocket. The storage pocket has fixed hook, velcro tape, and waistband strap for connecting the pocket to the buoyancy control (or life jacket) and accommodating the buoy and the fixing rope when the safety stop anchor is not in use and the buoy is folded into a small volume. When a diver intends to return to the surface, the buoy can be inflated under water to float on water surface. At this point, the diver is bound by the fixing rope, which is connected at one end to the buoy and at another end to the storage pocket, to stay at a specified decompression stop under water for a specified time to breath in normal condition for decompression purpose, so as to avoid caisson disease caused by dissolution of nitrogen in the diver's body.

BRIEF DESCRIPTION OF THE DRAWINGS

FIG. 5-1 is an enlarged, fragmentary perspective view showing the manner in which the storage pocket is attached to the waistband of the buoyancy control;

FIG. 7-1 is an enlarged, fragmentary perspective of FIG. 7 showing the relation between the 3-meter swivel hook and the fixed pocket link in the storage pocket;

DETAILED DESCRIPTION OF THE PREFERRED EMBODIMENTS

Figure 1:
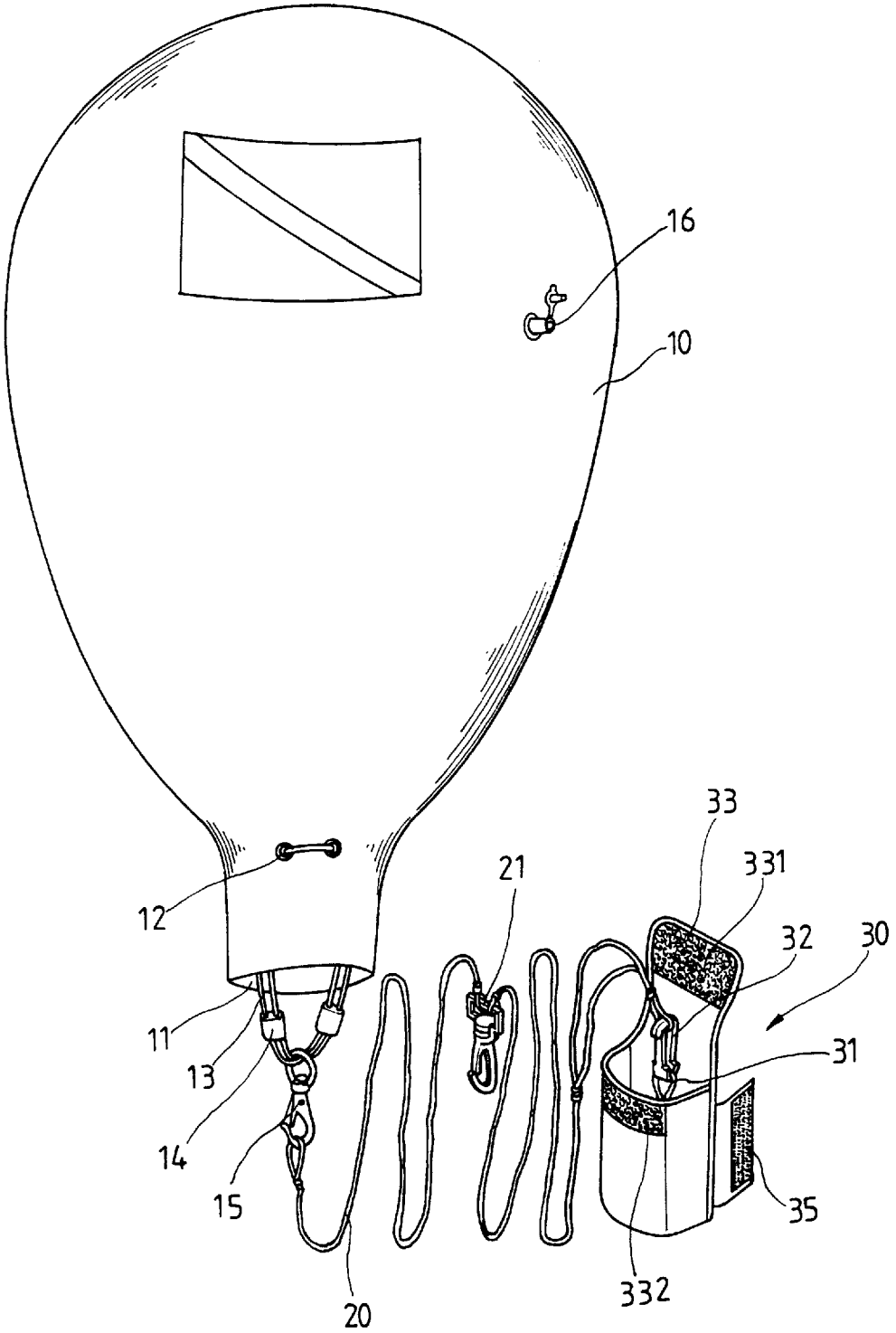
FIG. 1 is a perspective of the present invention with the buoy thereof in an inflated state for use.
Figure 3:
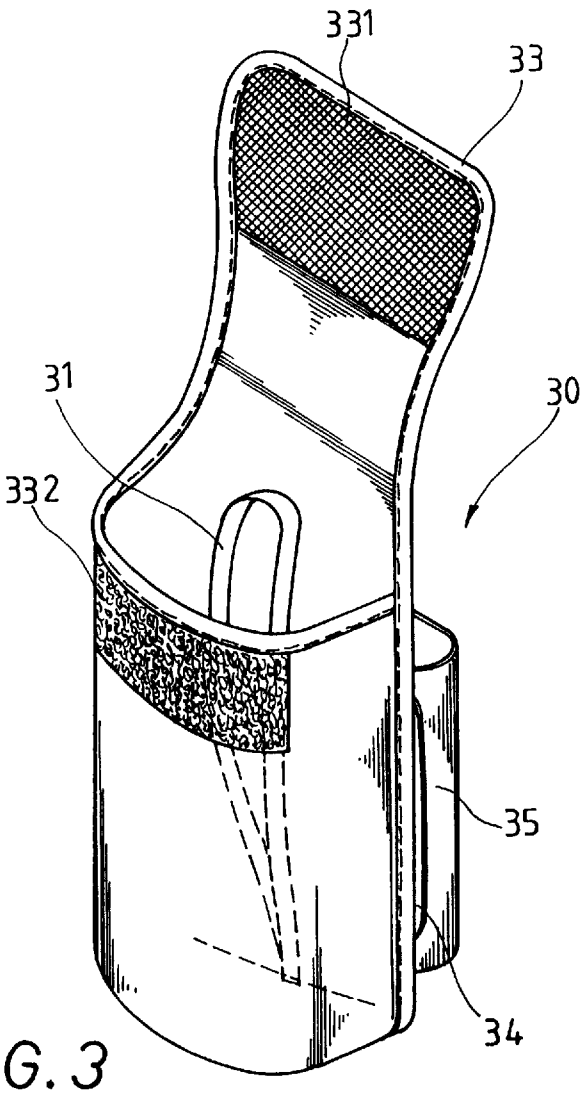
FIG. 3 shows an empty and opened storage pocket of the present invention to show internal structure thereof.
Figure 2:
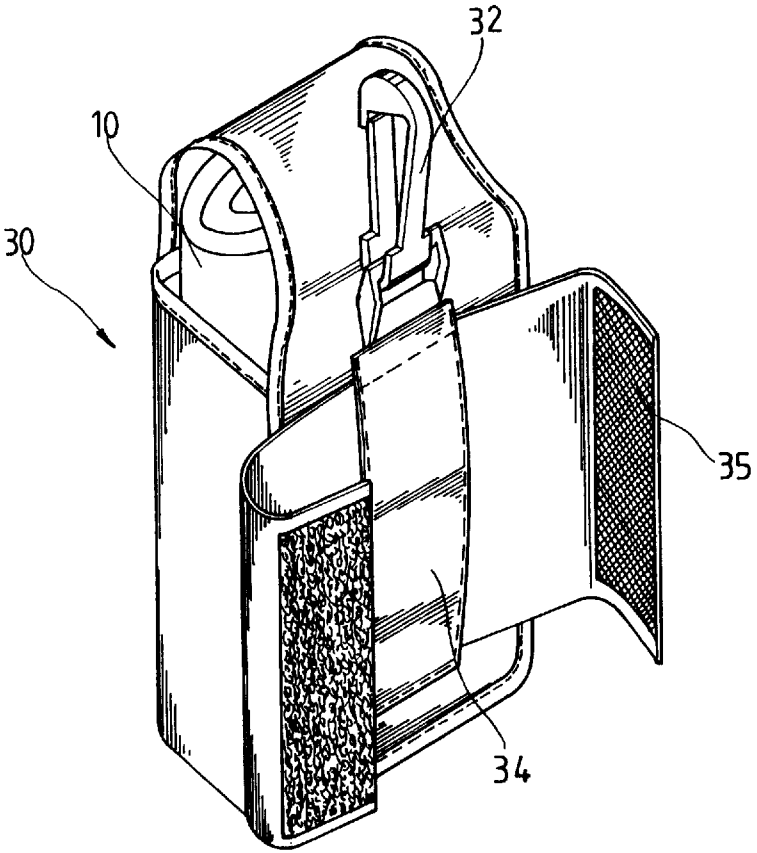
FIG. 2 is a perspective rear view of the storage pocket of the present invention with the buoy deflated and folded into a small volume for storing in the storage bag.

Please refer to FIGS. 1, 2 and 3. The present invention relates to a safety stop anchor which mainly includes a buoy 10, a length of fixing rope 20, and a storage pocket 30.

The buoy 10 can be of any shape and is preferably an oval or spherical bag having a bottom opening 11 serving as a gas inlet. A plurality of through holes 12 are adequately spaced around a portion of the buoy 10 at an adequate distance above the bottom opening 11. A string 13 is extended into the bottom opening 11 to sequentially thread through the through holes 12. At least one weight 14 is connected to the string 13, so that the buoy 10 may float on water in a vertical position. It is preferable that the through holes 12 and the string 13 are distant from a lower edge of the gas inlet 11 for about 10 cm, so that the gas inlet 11 has a long neck. When the string 13 is pulled and tightened around the long neck of the gas inlet 11, the lower edge of the gas inlet 11 flares to facilitate inflation of the buoy 10. The string 13 also extends through a top ring of a first swivel hook 15 opposite to the through holes 12, making the buoy 10 look like a hot-air balloon. In another embodiment of the present invention, the at least one weight 14 is omitted and the first swivel hook 15 is made of metal material. With the load of the metal swivel hook 15, it may serve as a weight to keep the buoy 10 floating in a vertical position. By this way, parts needed by the present invention can be reduced. Standard flag designs for international and American diving organizations can be printed on outer surface of the buoy 10. A buoyancy control valve 16 is provided at upper portion of the buoy 10 to assist in lifting loads.

Figure 6:
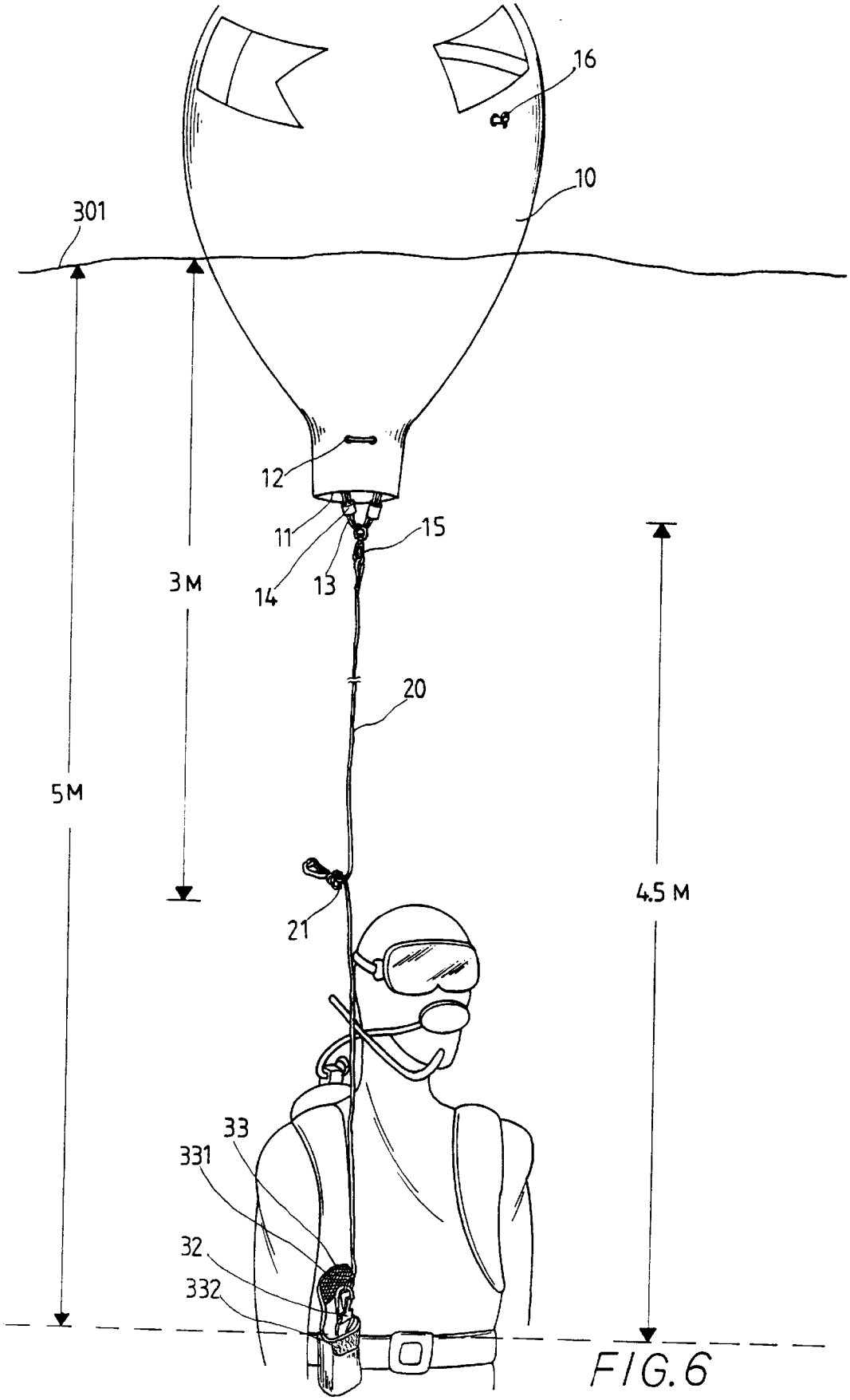
FIG. 6 illustrates a preferred embodiment of the present invention in use enabling the user to stay under water at the five-meter safety stop.

The fixing rope 20 includes two loops at two ends thereof and has a length about 4.5 meters. A first loop end of the fixing rope 20 is connected to a hook portion of the first swivel hook (or the weight hook) 15 below the bottom opening 11 of the buoy. Another second loop end of the fixing rope 20 is connected to a first fixed hook (or 5-meter hook) 32 which is in turn connected to a link 31 fixedly provided in the storage pocket 30. As shown in FIG. 6, the fixing rope 20 in full length together with a portion of the buoy 10 between the water surface and the first swivel hook (or the weight hook) 15 (included) define a depth about five meters which is the "safety stop" strictly required by PADI, NAUI, CMAS, and other international diving organizations for safe decompression purpose. A second swivel hook (or 3-meter hook) 21 is connected to a 3-meter divisional point on the fixing rope 20. Also as shown in FIG. 6, the distance between the water surface and the divisional point on the fixing rope 20 defines a three-meter depth below the water surface which, as known by general divers, is an important decompression stop at where general divers most commonly stay for decompression purpose. With the second swivel hook (3-meter hook) 21, the 4.5-meter long fixing rope 20 providing the 5-meter safety stop under water can be adjusted shorter and therefore provides the 3-meter safety decompression stop for the user.

The storage pocket 30 is a substantially rectangular pocket defining a space for fitly accommodating a deflated and folded buoy 10, the fixing rope 20, and other parts connected to the fixing rope 20. A pocket link 31 is fixedly and firmly connected at one lower end to an inner bottom edge of the storage pocket 30, as shown in FIG. 3, and is connected at another upper end to the first fixed hook (or the 5-meter hook) 32 on the fixing rope 20. A back piece of the storage pocket 30 extends upward to form a flap 33 of the pocket 30. A piece of male-type velcro tape 331 is provided over an inner surface of the flap 33 to engage with a piece of female-type velcro tape 332 attached to an upper front outer portion of the storage pocket 30, so that the storage pocket 30 can be openably closed by the flap 33. A first strap 34 is lengthwise connected at two ends to an outer back surface of the storage pocket 30 to define a passage between the first strap 34 and the pocket 30. A second strap 35 transversely extends through the passage between the first strap 34 and the storage pocket 30 with two ends thereof detachably connected to one another by means of male and female velcro tapes, as shown in FIG. 2. A second fixed hook 32 is connected to an upper end of the first strap 34.

When the safety stop anchor is not in use, the buoy 10 is deflated and folded into a small roll and is positioned in the storage pocket 30 with a small top portion of the folded buoy 10 projected from an upper edge of the pocket 30, as shown in FIG. 2, so that the buoy 10 can be easily pulled out from the storage pocket 30 by the diver for use.

Figure 4:
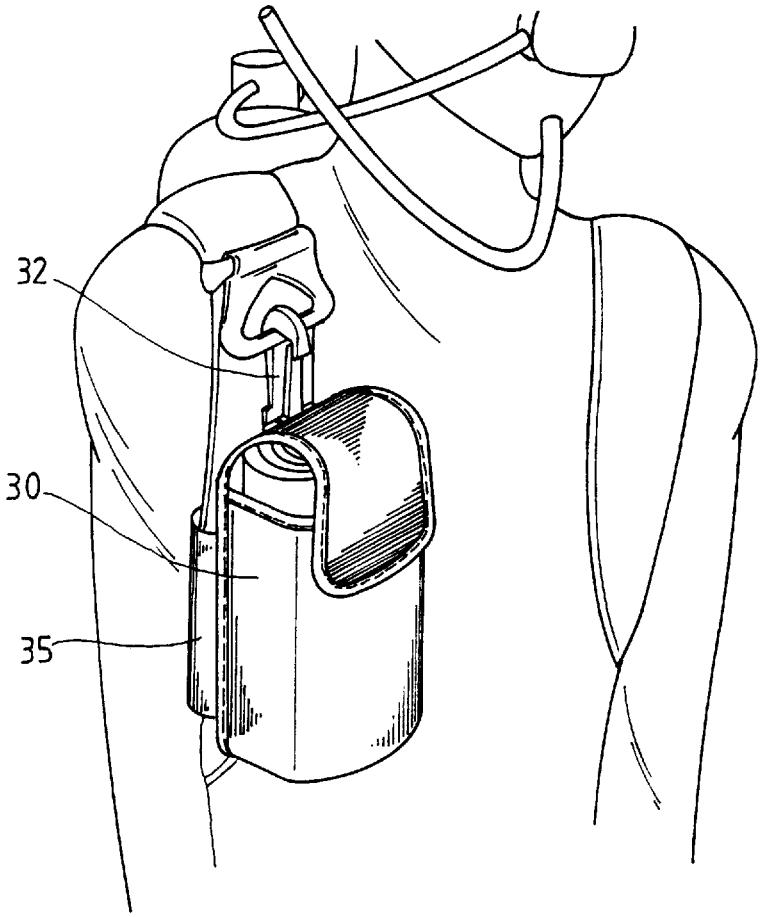
FIG. 4 illustrates the storage pocket of the present invention with the folded buoy stored therein being attached to a D-buckle on a buoyancy control when the present invention is not in use.
Figures 1, 5:
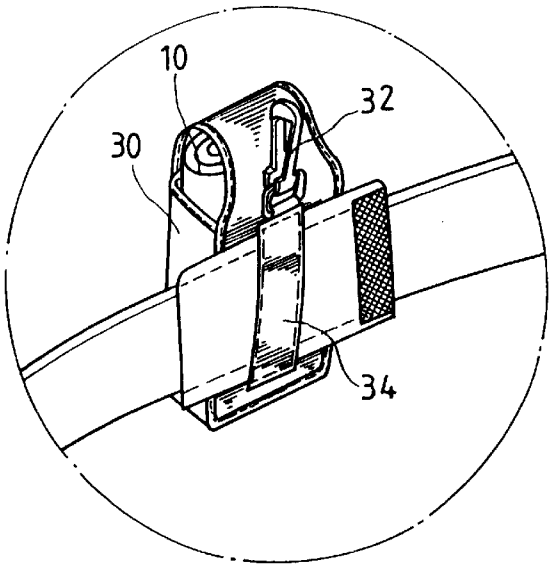
FIG. 5 illustrates the storage pocket of the present invention with the folded buoy stored therein being attached to a waistband of the buoyancy control when the present invention is not in use.
Figure 5:
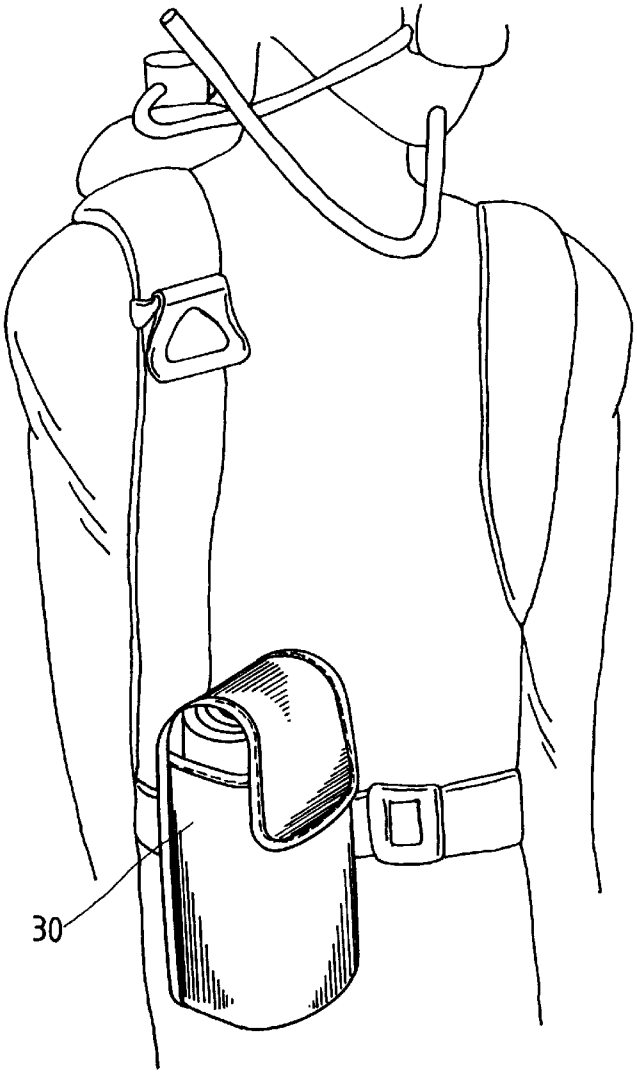

To carry the present invention for use in an underwater activity, a diver may connect the second fixed hook 32 provided at the back of the storage bag 30 to a D-buckle on the buoyancy control or life jacket and wrap the second strap 35 around a shoulder strap of the buoyancy control (life jacket) to prevent the storage pocket 30 from drifting due to wavy currents under water. Alternatively, the diver may carry the storage pocket 30 by threading a waist band of the buoyancy control (life jacket) through the passage between the first strap 34 and the pocket 30, as shown in FIGS. 5 and 5-1. The ways shown in FIGS. 4, 5, and 5-1 for carrying the present invention with the diver all use existing parts on the present invention and the buoyancy control, so that the storage pocket 30 can be more conveniently attached to the buoyancy control for use. However, it is understood that any other equivalent fixing manner can also be adopted so long as they meet the requirement of safety in use.

Figures 1, 7:
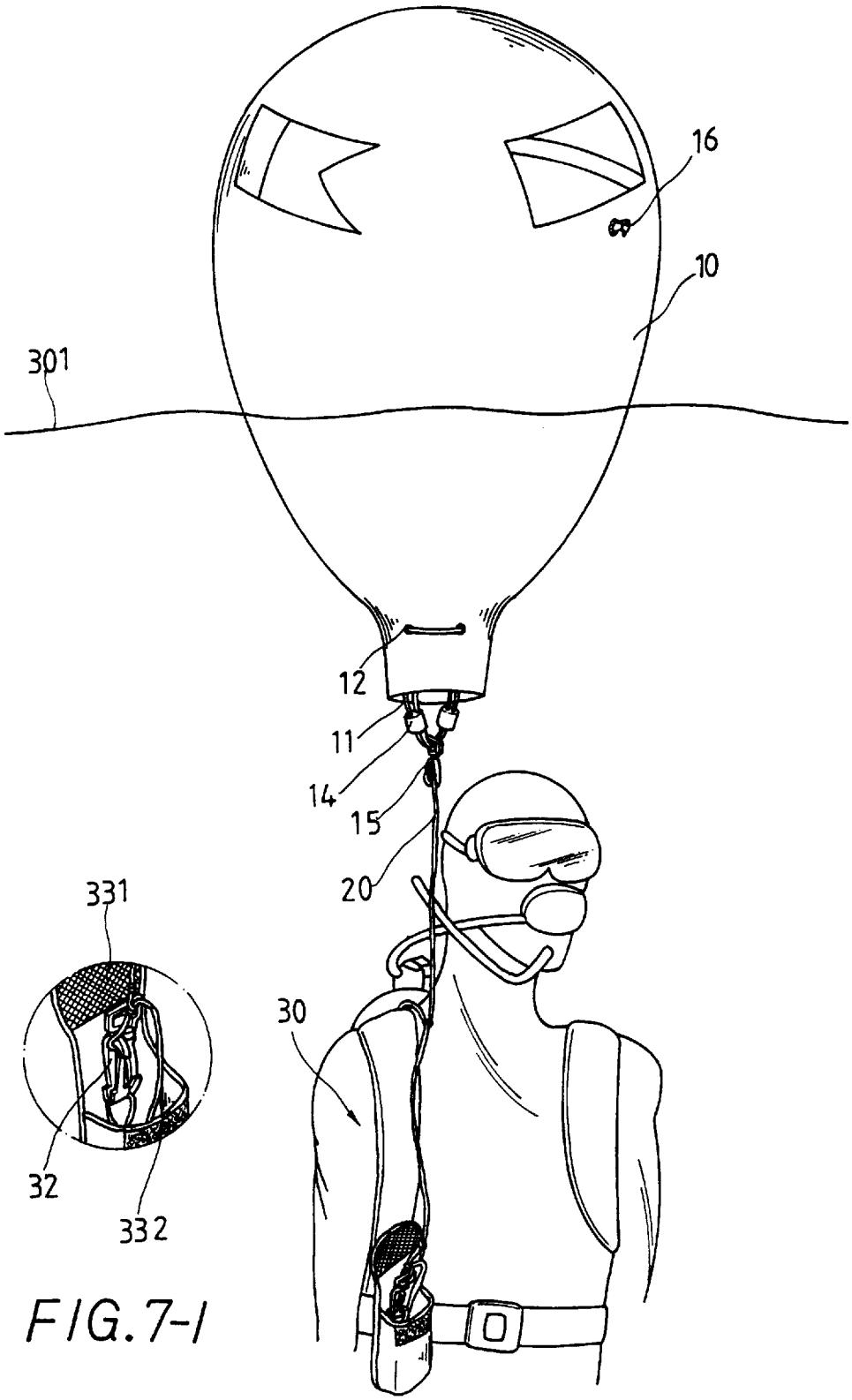
FIG. 7 illustrates the preferred embodiment of the present invention in use enabling the user to stay under water at a three-meter decompression stop.
Figure 8:
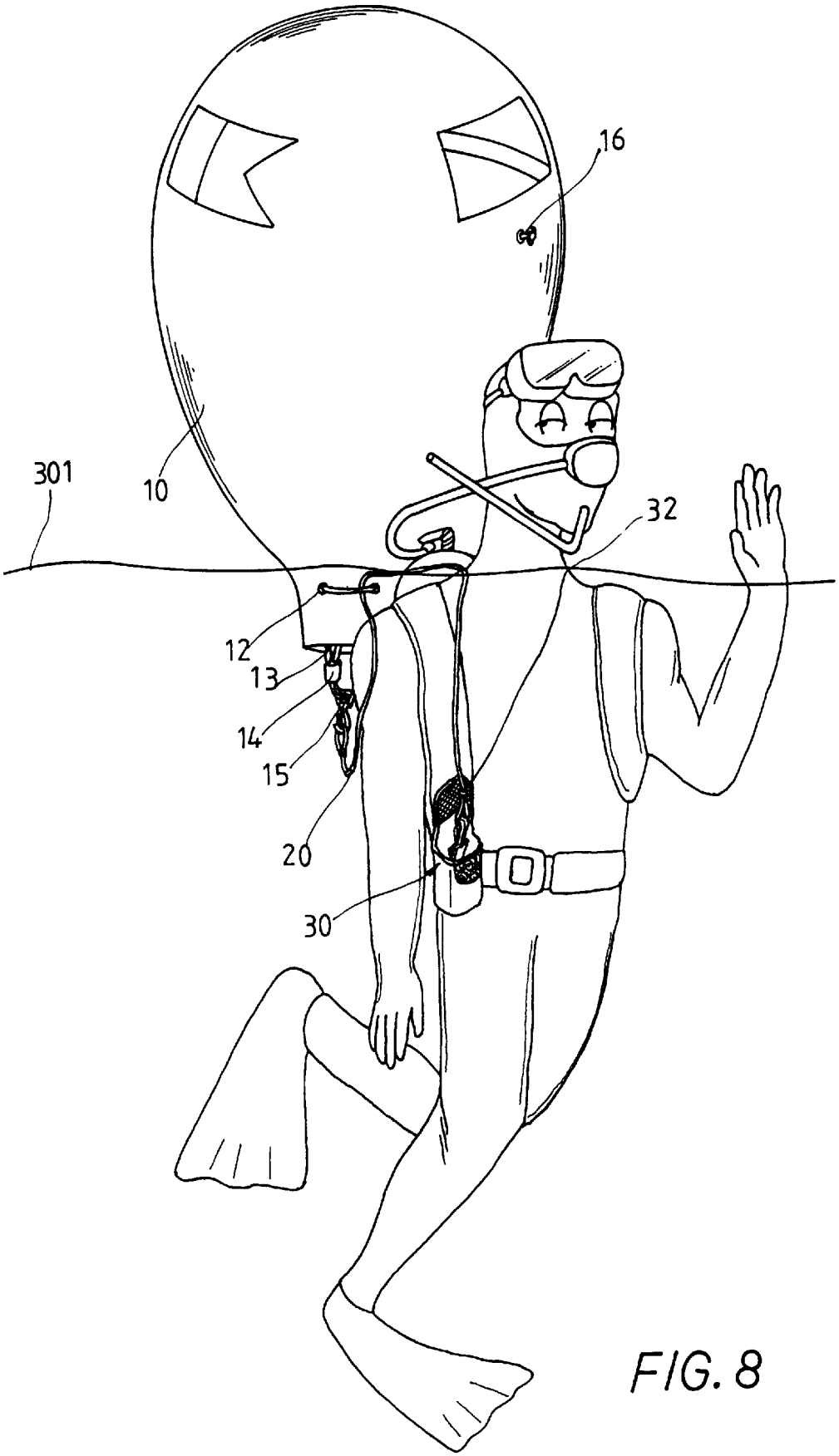
FIG. 8 illustrates the diver has safely returned to the water surface with the help of the present invention.

Please now refer to FIGS. 6 to 8 at the same time. When the diver has been under water for quite a long time and intends to return to the water surface 301, it is a specified and necessary practice for the diver to stay at several different depths below the water surface 301, that is, to stay at the so-called safety decompression stops for a predetermined time period to adapt himself or herself to the dropped pressure before he or she returns to the water surface 301, so as to avoid the caisson disease. (Divers may refer to U.S. Navy Standard Air Decompression Tables for relevant information about these decompression stops.) To stay at a safety decompression stop, the diver may lift the flap 33 to open the storage pocket 30 and pull out the folded buoy 10. The buoy 10 may be inflated by mouth or by compressed air in the aqualung, so that it gradually ascends and finally floats on the water surface 301 due to the air in the buoy 10. Since the most commonly adopted depth for safety decompression stop, particularly for divers engaging in general underwater activities and/or underwater engineering works, is five meters below the water surface 301, the diver may further connect the second swivel hook 21 on the 3-meter divisional point on the fixing rope 20 to the D-buckle on the buoyancy control or to the pocket link 31 in the storage pocket 30. By doing this, the diver may ascend and stay at three meters below the water surface 301 (that is, stay at the 3-meter safety decompression stop) for a specified time period and then gradually ascend to finally return to the water surface 301.

Figure 9:
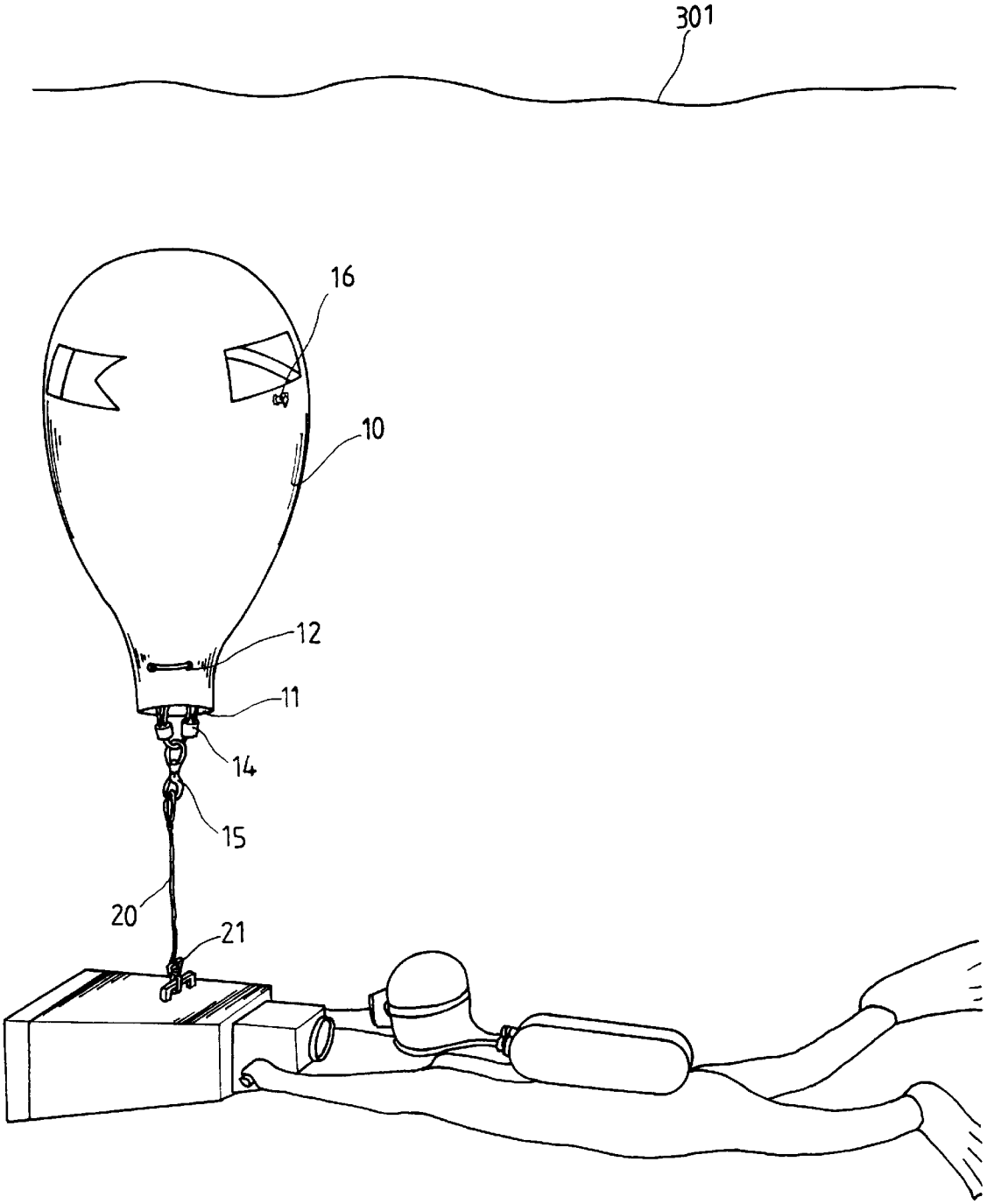
FIG. 9 illustrates the present invention is used to assist in carrying a heavy load under water.

FIG. 9 illustrates that the present invention is used to carry a heavy load, such as a diving camera, under water. When the buoy 10 is getting closer to the water surface 301, water pressure outside the buoy 10 drops while air buoyancy in the buoy 10 increases. To keep the heavy load carried by the buoy 10 adequately afloat in the water by the buoyancy of water, the buoyancy control valve 16 provided on the buoy 10 at about two-third of a height of the buoy 10 may be opened at this point to release extra air in the buoy 10 via the valve 16, so that the buoy 10 is adjusted to have a neutral buoyancy to facilitate adequate floating of the heavy load in the water. By this way, the heavy diving camera can be more easily carried and manipulated by a photographer underwater. Even in the case of carrying very bulky and heavy salvage, the buoy 10 can be used without the risk of becoming over-swollen and burst, because extra air in the buoy 10 may also escape from the buoy 10 via the bottom opening 11 without causing a burst buoy 10.

Figure 10:
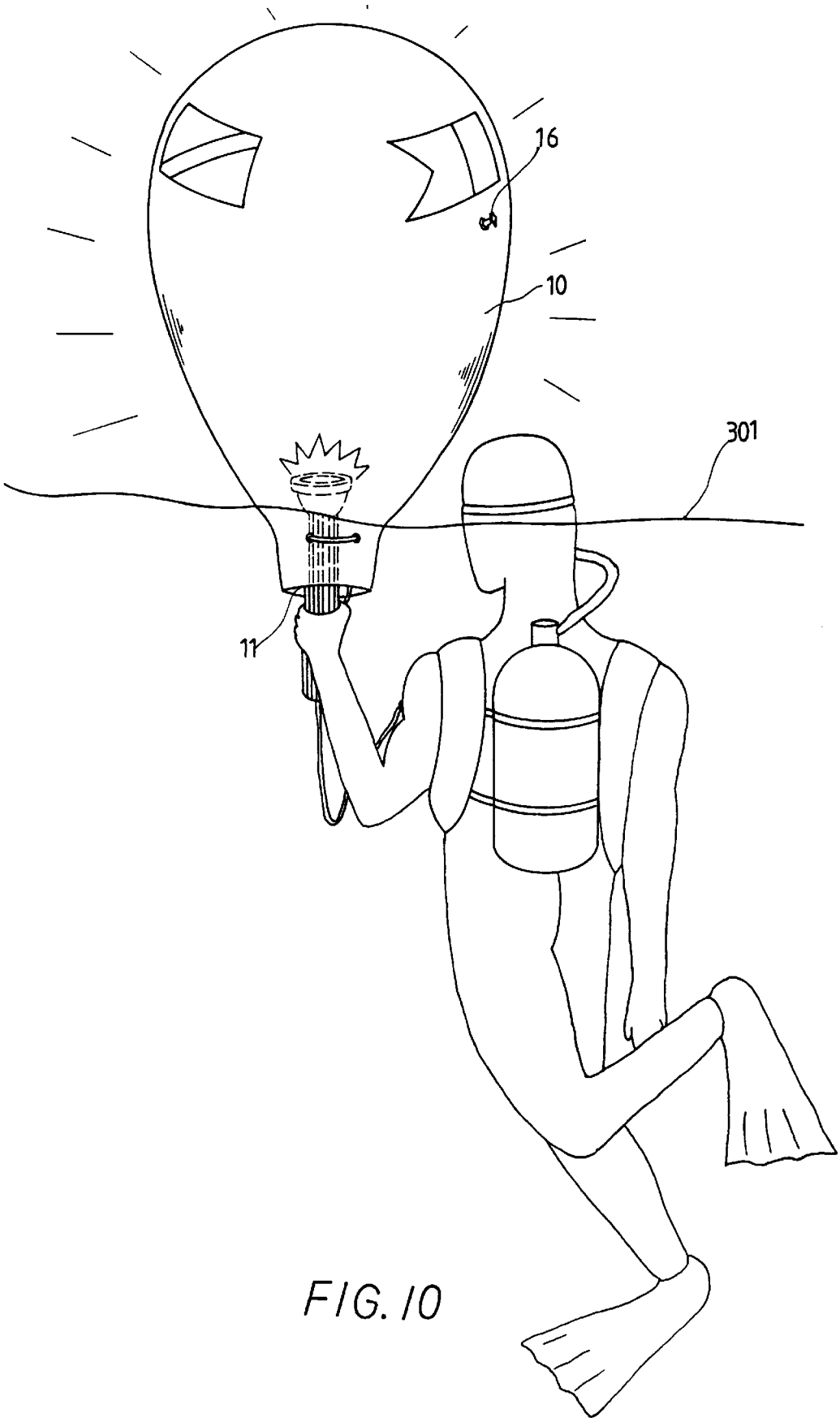
FIG. 10 illustrates the present invention is used to assist in sending an SOS signal.

FIG. 10 illustrates that the present invention is used by a diver as an aid to send SOS light signal. As a common practice or diving, the buoy 10 is usually in orange color. Normally, in the event of an emergency in diving, the diver will usually call for help by lightening a flashlight under water to project light upward, or by swaying the flashlight above the water surface. Such SOS signal has poor effect and is easily mistaken by passing vessels for normal lighting of general fishers, and the diver might very possibly lose the chance of being rescued. However, if the diver in dangers extends the flashlight into the buoy 10 via the bottom opening 11, light from the flashlight is diffused in the buoy 10 to make the whole buoy 10 luminous over the water surface 301. Since the orange color is a special signal in diving, the luminous orange buoy 10 forms a better warning sign or SOS signal.

With the above arrangements, the present invention has following advantages:

1. The diver may connect the second swivel hook (3-meter hook) on the fixing rope to a proper position on the buoyancy control or life jacket to stay at an adequate depth below the wavy sea without a depth gauge and struggling to keep himself or herself at that depth. The diver may successfully adapt himself or herself to the dropped pressure while taking a rest.
2. When the buoy is inflated and floating on the water surface, it serves as a very good signal to inform others the diver will return to the water surface very soon. A cooperative boat may therefore approach the buoy under control to pick up the diver later. The floating buoy also serves as a good warning sign because the flag designs of various diving organizations printed on the buoy may warn vessels around the area that divers are proceeding underwater works somewhere below them, so that these vessels may keep away from the buoy for at least 30 meters (or about 100 feet) to avoid any accident.

3. When the present invention is not in use, the buoy and the fixing rope can be folded into a small volume for storing in the storage pocket with a small top portion of the folded buoy projected from the pocket, so that the folded buoy may be easy pulled out from the pocket for use when necessary.

4. For divers engaging in archaeological study or salvage, when heavy and bulky corals, ancient articles, or treasuries have been collected, the inflated buoy can be used as an aid to carry such heavy and bulky loads. What is to be noted is loads hung below and carried by the buoy must not be larger than the buoyancy of air inside the buoy. If necessary, additional buoy or buoys may be used at the same time to together carry the loads.

5. The first and second swivel hooks (that is, the weight and the 3-meter hooks) respectively connected to one end and a divisional point of the fixing rope have a hook portion that can freely swivel relative to a head portion of the hooks, thereby the fixing rope will not tangle with the buoy for the buoy to successfully inflate. Moreover, the through holes 12 on the buoy 10 are provided at a distance from the bottom opening 11, allowing the bottom opening to flare when the string 13 is tightened, so that the buoy can be easily inflated.

6. When the diver intends to use a flashlight to send out SOS signal, the flashlight may be extended into the buoy via the bottom opening. Light from the flashlight shall diffuse in the buoy and makes the buoy luminous to effectively form a warning sign.

What is claimed is:

1. A safety stop anchor comprising a buoy, a length of fixing rope, and a storage pocket;

said buoy being preferably an oval or spherical bag and having a bottom opening to serve as a gas inlet, a plurality of through holes being spaced around a lower portion of said buoy at a distance from said bottom opening, a fastening string being threaded through said through holes from inside of said bottom opening for holding a first swivel hook below said bottom opening;

said fixing rope including first and second loop ends and having a length about 4.5 meters, said first loop end of said fixing rope being connected to a swivel hook portion of said first swivel hook below said bottom opening of said buoy, said second loop end of said fixing rope being connected to a first fixed hook which is in turn connected to a fixed link provided in said storage pocket, a second swivel hook being connected to a divisional point on said fixing rope, so that a distance about 3 meters is defined between said second swivel hook and a water surface; and said storage pocket defining a rectangular space for storing said buoy in a deflated and folded form, a fixed link being fixedly and firmly connected at one lower end to an inner bottom edge of said storage pocket for said first fixed hook on said fixing rope to connect thereto, a back piece of said storage pocket extending upward to form a flap of said storage pocket, male-type velcro tape being provided over an inner surface of said flap to detachably engage with female-type velcro tape provided at an upper front outer portion of said storage pocket, so that said storage pocket is openably closed by said flap, a first strap being lengthwise connected at two ends to an outer back surface of said storage pocket to define a passage between said first strap and said pocket for a second strap with velcro-taped ends to transversely extend therethrough, and a second fixed hook being connected to an upper end of said first strap;

whereby when a diver needs to adapt himself or herself to a dropped pressure at a suitable depth below the water surface before he or she returns to the water surface, said buoy can be inflated under water to float on water surface with said first fixed hook at said second loop end of said fixing rope or said second swivel hook on said divisional point of said fixing rope connected to said fixed link in said storage pocket while said pocket is fixedly connected to a proper position on the buoyancy control wearing by the diver, such that the diver may stay at safety decompression stop or stops under water in a relaxed condition.

2. A safety stop anchor as claimed in claim 1, wherein said fastening string threaded through said through holes near said bottom opening of said buoy has at least one weight connected thereto.

3. A safety stop anchor as claimed in claim 1, wherein said first swivel hook connected to said fastening string threaded through said through holes near said bottom opening of said buoy is made of metal material to serve as a weight.

* * * * *